United States Patent [19]

Crisci

[11] Patent Number: 4,834,252

[45] Date of Patent: May 30, 1989

[54] TAMPER EVIDENT CLOSURE WITH HANDLE

[75] Inventor: Harry E. Crisci, New Castle, Pa.

[73] Assignee: C.C.D.J., Inc., Westlake, Ohio

[21] Appl. No.: 247,613

[22] Filed: Sep. 22, 1988

[51] Int. Cl.[4] ..... B65D 41/34

[52] U.S. Cl. ..... 215/256; 215/100 A

[58] Field of Search ..... 215/228, 256, 100 A; 220/94 R, 212, 270

[56] References Cited

U.S. PATENT DOCUMENTS

| | | | |
|---|---|---|---|
| 3,000,527 | 9/1961 | Jennings et al. | 215/100 A |
| 3,119,541 | 1/1964 | Lynn | 215/100 A |
| 3,142,402 | 7/1964 | Fox | 215/256 |
| 3,275,366 | 9/1966 | Hidding | 215/100 A X |
| 3,311,252 | 3/1967 | Swartwood et al. | 215/100 A |
| 3,623,633 | 11/1971 | Kinn | 220/94 R |
| 3,638,823 | 2/1972 | McCoy | 215/100 A |
| 4,342,400 | 8/1982 | Llera | 215/256 |
| 4,506,797 | 3/1985 | Bullock | 215/256 |
| 4,534,481 | 8/1985 | Summers et al. | 215/256 X |

*Primary Examiner*—Donald F. Norton

*Attorney, Agent, or Firm*—Harpman & Harpman

[57] ABSTRACT

A tamper evident flexible closure with an integral formed handle for a container having a neck portion with a fastening configuration surrounding an opening therein and an annular outturned rib therebelow; the closure including a cap portion with an annular depending flange on its peripheral edge, a tear shirt including a pull tab depending from said annular depending flange and a ring carrying a handle depending from the tear skirt, the tear skirt and the ring being capable of extending over the annular rib on the container to position the ring below the annular rib and arranged to support the container and its contents by the handle before and after the tear skirt has been removed.

7 Claims, 1 Drawing Sheet

TAMPER EVIDENT CLOSURE WITH HANDLE

BACKGROUND OF THE INVENTION

1. Technical Field

This invention relates to tamper evident flexible closures with handles integrally formed therewith for containers such as blow molded containers useful for packing various beverages and the like.

2. Description of Prior Art

Flexible handles on rings adapted to be applied to containers may be seen in U.S. Pat. Nos. 3,000,527 and 3,311,252.

A handle comprising a flexible strip having its opposite ends secured at spaced locations on a container may be seen in U.S. Pat. No. 3,623,633 and handles pivotally attached to rings for application to containers are disclosed in U.S. Pat. Nos. 3,275,366 and 3,638,823. Tear skirts are relatively common in the closure art and one such tear skirt having a closure on one side and a cylindrical bottle neck cover therebelow is disclosed in U.S. Pat. No. 4,506,797.

The present invention provides a device having the dual function of a closure with a tamper evident portion which must be removed to permit the closure to be disengaged from the container and positions a ring therebelow adapted to be engaged over and positioned beneath an annular rib on the neck portion of the container. A flexible handle is integrally formed with the ring and the tear skirt has thin wall, frangible connecting portions joining the uppermost portion of the tear skirt to the lower edge of the annular depending flange of the closure and the lowermost portions of the tear skirt to the upper edge of the ring carrying the handle.

SUMMARY OF THE INVENTION

A tamper indicating closure for a container with appropriate neck configurations takes the form of a cap portion having a top with a depending flange on its peripheral edge and a depending flexible annular tear skirt extending downwardly from the depending flange together with an integrally formed ring formed on the lower edge of the flexible tear skirt, the ring having an integrally formed flexible handle. A pull tab on the depending flexible annular tear skirt enables the same to be removed from the device permitting the closure to be disengaged from the container on which it is positioned and the ring with the handle remains on the container.

DESCRIPTION OF THE PREFERRED EMBODIMENT

Figure 1:
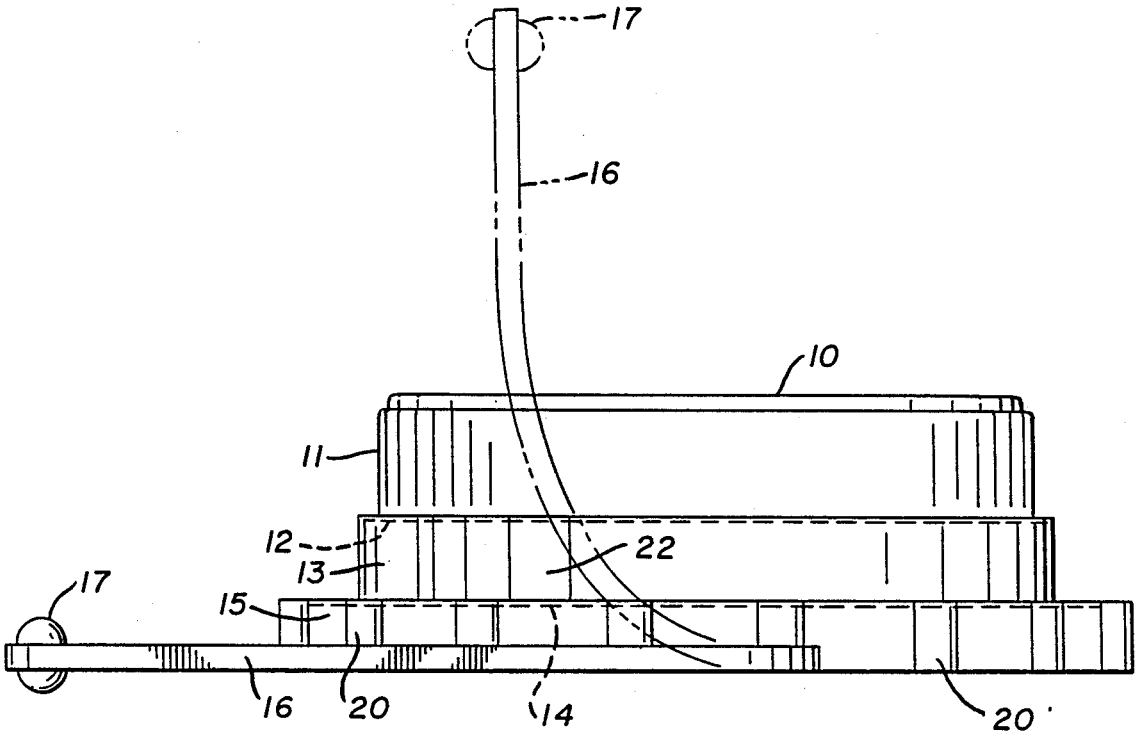
FIG. 1 is a side elevation of the tamper evident closure with handle, broken lines indicating an alternate position of the handle.

By referring to the drawings and FIG. 1 in particular a side elevation of the tamper evident flexible closure with handle for a container may be seen, the closure including a top portion 10 with a depending annular flange 11 joined by a thin frangible wall 12 to the upper edge of a depending distortable annular tear skirt 13. The lower edge of the annular tear skirt is integrally joined by a second thin frangible wall 14 to the upper edge of an annular ring 15 which in turn is integrally formed with a flexible handle 16 of a generally U-shape, the ends of the arms of the generally U-shaped handle 16 extending from locations on the opposite sides of the ring 15. The handle 16 is initially formed as illustrated in solid lines in FIG. 1 of the drawings and like the remainder of the tamper evident closure is flexible and capable of being moved to an upright position as shown in broken lines in FIG. 1. The base of the generally U-shape of the handle 16 is a straight portion extending between the arms of the handle 16 and oppositely disposed ribs 17 are formed thereon to reinforce the same and provide a more convenient and comfortable hand grip.

Figure 2:
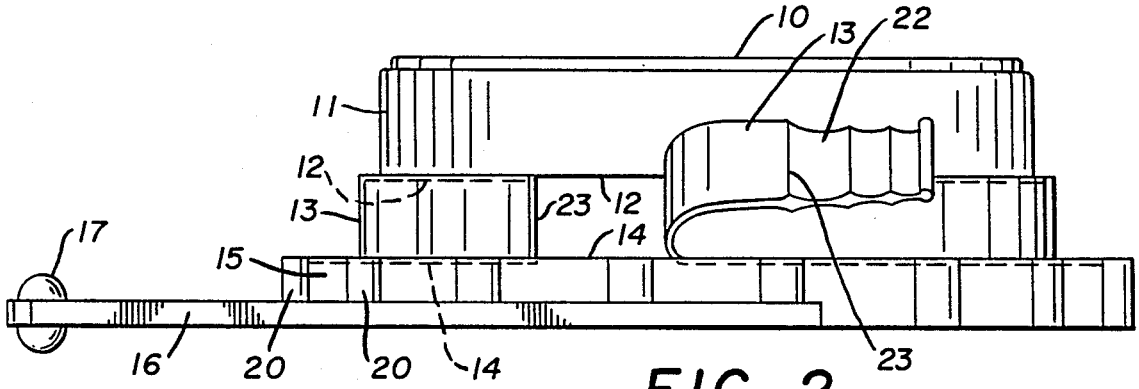
FIG. 2 is a side elevation of the tamper indicating closure with handle showing a portion of the tear skirt removed therefrom.
Figure 3:
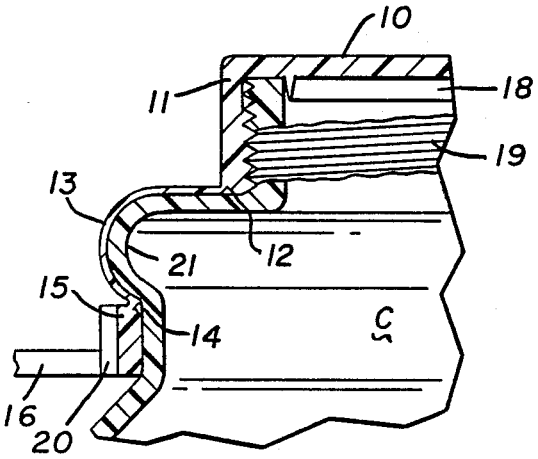
FIG. 3 is a vertical section through a portion of the tamper evident closure with handle and a portion of a neck of a container on which the closure with handle is applied showing the engagement of the flexible tear skirt over an annular rib on the neck of the container.
Figure 4:
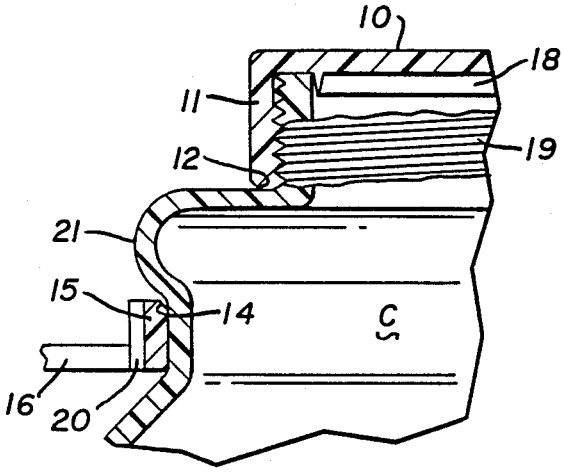
FIG. 4 is a vertical section through a portion of the tamper evident closure with handle after the tear skirt has been removed and showing the closure on a portion of the neck of a container in sealing relation and the ring with the handle securely engaged on the container beneath the annular rib thereof.

The tamper evident closure with the handle is formed of a resilient molded plastic material. The several portions of the closure being molded of different thicknesses of material, for example the top 10 of the cap portion is of a first known thickness so as to be able to carry an annular downturned sealing flange 18, see FIGS. 3 and 4, on its inner surface. The depending flange 11 on the peripheral of the top 10 has a relatively thicker wall section than the known thickness of the top 10 and is preferrably provided with a continuous thread pattern 19 on its inner surface, see FIGS. 3 and 4. The continuous thread pattern may be formed in an interrupted configuration and the configuration of the thread pattern used to frictionally engage a neck portion of a container or it may threadably engage the same as illustrated in the embodiment of the invention shown in FIGS. 3 and 4 of the drawings. The lower edge of the depending flange 11 is integrally formed with the thin deformable resilient flexible tear skirt 13 and the thin wall section of the tear skirt 13 extends from the thin frangible wall 12 where it joins the lower edge of the annular flange 11 to the second thin frangible wall 14 by which it is affixed to the upper edge of the ring 15. The ring 15 is formed with a somewhat thicker annular body and reinforced by a plurality of circumferentially spaced ribs 20 positioned vertically on the exterior of the ring 15. The ribs 20 and the handle 16 are arranged to permit the ring 15 to be stretched and positioned downwardly over an annular rib 21 formed on a container C just below the neck portion thereof which receives the cap portion of the closure. The resilient quality of the material from which the closure is made and the differing thicknesses of the several wall sections enable the ring 15 to be self-retaining on the container beneath the annular rib 21 so that when the container such as a two liter size is filled with a beverage the same can be picked up and carried by the handle with no possibility of the ring and handle moving away from their position beneath the annular rib 21 on the neck of the container. Still referring to FIG. 3 of the drawings it will be seen that when the ring 15 is moved downwardle forceably over the annular rib 21 on the container C the flexible and resilient tear skirt 13 is stretched to conform with the shape of the annular rib 21 to which it closely adheres and the thin frangible wall 12 and the secondary thin frangible wall 14 are spaced vertically and horizontally with respect to one another. By referring now to FIGS. 1 and 2 of the drawings, it will be seen that the depending flexible tear skirt 13 has a pull tab 22 formed integrally therewith which extends beyond a vertically positioned frangible wall 23 defining the ends of the flexible tear skirt 13 and that when the pull tab 22 is grasped and moved to the right as shown in FIG. 2 of the drawings, the thin frangible walls 12,14 & 23 will separate with the one end of the flexible tear skirt 13 moving away from its engagement with the annular flange 11 and the ring 15 so as to be completely removed from the tamper evident closure with handle leaving the closure portion of the device on the container C as shown in FIG. 4 of the drawings and the ring 15 with the handle 16 still positioned on the neck of the container C and beneath the annular rib 21 thereon.

It will occur to those skilled in the art that the distorted position of the flexible tear skirt 13 of the device performs two functions. The first of these occuring when it is removed providing visible evidence of the fact that the closure has been tampered with and/or opened and second assisting in securing the cap portion of the device including the top 10 and the annular depending flange 11 in position on the neck of the container C around the opening thereof and in sealing relation thereto. There is a supplemental or a third advantage which is best illustrated in FIG. 3 of the drawings wherein it will be observed that when the flexible tear skirt 13 is in stretched installed position it assists in holding and positioning the ring 15 on the neck of the container C beneath the annular rib 15 on the container. This fact contributes to the security of the placement of the ring 15 to which the handle 16 is attached insuring that it will not accidentally move upwardly and over the annular rib 21 of the container when the container and its liquid contents are lifted by the handle.

It will thus be seen that the tamper evident flexible closure with handle for a container disclosed herein has an effective sealing means with respect to the opening in the container over and around which it is positioned as well as the tamper evident tear skirt which changes the appearance of the closure substantially when it is removed and it provides a higher desirable convenient and practical handle for carrying the container and the beverage or other liquid contained therein. An additional advantage inherent in the construction disclosed is the ability of the closure portion of the device to be reapplied to the container about the opening therein to provide resealing or closing of the same as desired.

Having thus described my invention, what I claim is:

1. A tamper-evident closure with handle integrally formed of resilient plastic material comprising a top portion, a depending annular flange on said top portion and a peripheral tear skirt depending from said depending annular flange, a ring depending from said peripheral tear skirt, said peripheral tear skirt being shaped to conform tightly to an external annular rib on a container, said ring being shaped to conform tightly to the container beneath said external annular rib, a first frangible wall extending circumferentially of said peripheral tear skirt adjacent said depending annular flange, a second frangible wall extending circumferentially of said peripheral tear skirt adjacent said ring, a vertical frangible wall in said peripheral tear skirt and a pull tab on said peripheral tear skirt adjacent said vertical frangible wall, a generally U-shaped handle having arms and a base portion with the arms engaging said ring in circumferentially spaced relation, the base of said handle extending between said arms spaced with respect to said ring.

2. The tamper-evident closure with handle according to claim 1 wherein said depending annular flange on said top portion is of a known diameter, the peripheral tear skirt being of a greater diameter than said depending annular flange and said ring being of a greater diameter than said peripheral tear skirt.

3. The tamper-evident closure with handle according to claim 1 wherein fastening configurations are formed on the inner surface of said depending annular flange.

4. The tamper-evident closure with handle according to claim 1 wherein said depending annular flange is of a known thickness so as to be capable of retaining its formed shape and wherein said peripheral tear skirt is of a known thickness defining a thin wall stretchable to conform to said external annular rib on said container.

5. In combination, a tamper-evident closure with handle according to claim 1 and a container having a neck formed with said external annular rib and an external annular wall formed complementary to the interior of said depending annular flange and the interior of said ring respectively.

6. The tamper-evident closure with handle according to claim 1 and wherein said first frangible wall and said second frangible wall are continuously extending V-shaped grooves in said peripheral tear skirt where the same joins said depending annular flange and said ring respectively.

7. The tamper-evident closure with handle according to claim 1 which further comprises an annular depending sealing flange on the inner surface of said top portion spaced with respect to said depending annular flange.

* * * * *